US009359866B2

(12) United States Patent
MacKenzie

(10) Patent No.: US 9,359,866 B2
(45) Date of Patent: Jun. 7, 2016

(54) DOWNHOLE TOOL ACTUATOR

(71) Applicant: NOV Downhole Eurasia Limited, Stonehouse (GB)

(72) Inventor: Alan MacKenzie, Catterline (GB)

(73) Assignee: Nov Downhole Eurasia Limited, Gloucestershire (GB)

( * ) Notice: Subject to any disclaimer, the term of this patent is extended or adjusted under 35 U.S.C. 154(b) by 138 days.

(21) Appl. No.: 14/351,669

(22) PCT Filed: Oct. 9, 2012

(86) PCT No.: PCT/GB2012/052497
§ 371 (c)(1),
(2) Date: Apr. 14, 2014

(87) PCT Pub. No.: WO2013/054099
PCT Pub. Date: Apr. 18, 2013

(65) Prior Publication Data
US 2014/0246190 A1 Sep. 4, 2014

(30) Foreign Application Priority Data
Oct. 14, 2011 (GB) ..... 1117800.1

(51) Int. Cl.
*E21B 34/14* (2006.01)
*E21B 23/00* (2006.01)
*E21B 10/26* (2006.01)
(Continued)

(52) U.S. Cl.
CPC ..... *E21B 34/14* (2013.01); *E21B 10/26* (2013.01); *E21B 23/00* (2013.01); *E21B 34/06* (2013.01); *E21B 21/103* (2013.01)

(58) Field of Classification Search
CPC ..... E21B 34/14; E21B 10/26; E21B 21/103
See application file for complete search history.

(56) References Cited

U.S. PATENT DOCUMENTS 7,036,611 B2 * 5/2006 Radford ..... E21B 10/322 175/296
7,673,708 B2 * 3/2010 Lee ..... E21B 34/14 175/268

(Continued)

FOREIGN PATENT DOCUMENTS

WO 2008119931 10/2008
WO 2010129678 A2 11/2010
WO 2011094274 A2 8/2011

OTHER PUBLICATIONS

International Search Report for International Application No. PCT/GB2012/052497 dated Oct. 23, 2013.

(Continued)

*Primary Examiner* — Shane Bomar

(74) *Attorney, Agent, or Firm* — Andrus Intellectual Property Law, LLP

(57) ABSTRACT

A resettable downhole tool actuator comprises a housing, a collet slidable within the housing and defining a seating with which a ball is engageable, in use, the collet being mounted upon a moveable support including a piston and arranged such that, when the bail engages the seating, fluid flow through an axially extending passage provided in the support is restricted, the housing including an increased diameter region arranged such that, when the seating is aligned with the increased diameter region, outward deflection of the collet permits the ball to pass through the seating and through the axially extending passage.

9 Claims, 2 Drawing Sheets

Figure 1:
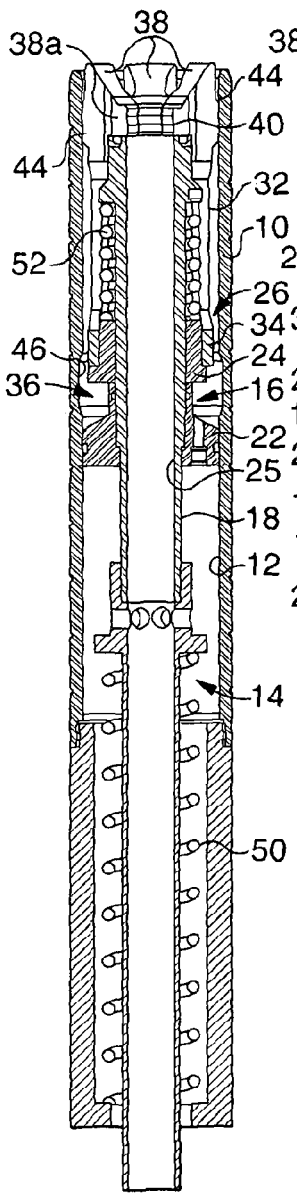

(51) Int. Cl.
*E21B 34/06* (2006.01)
*E21B 21/10* (2006.01)

(56) References Cited

U.S. PATENT DOCUMENTS 7,866,397 B2 * 1/2011 Lee ..... E21B 10/322 166/318
2006/0243455 A1 * 11/2006 Telfer ..... E21B 21/103 166/386
2007/0017679 A1 * 1/2007 Wolf ..... E21B 23/006 166/312
2008/0093080 A1 4/2008 Palmer et al.
2009/0084555 A1 * 4/2009 Lee ..... E21B 10/322 166/319
2009/0308588 A1 12/2009 Howell et al.
2010/0132954 A1 * 6/2010 Telfer ..... E21B 23/006 166/373
2011/0315390 A1 * 12/2011 Guillory ..... E21B 21/103 166/329
2016/0032686 A1 * 2/2016 Manning ..... E21B 41/00 166/244.1

OTHER PUBLICATIONS

British Search Report for GB1117800.1 dated Nov. 25, 2011.

* cited by examiner

DOWNHOLE TOOL ACTUATOR

CROSS REFERENCE TO RELATED APPLICATION

The present application is the U.S. national stage application of International Application PCT/GB2012/052497, filed Oct. 9, 2012, which international application was published on Apr. 18, 2003 as International Publication WO 2013/054099. The International Application claims priority of British Patent Application 1117800.1, filed Oct. 14, 2014, the contents of which are incorporated herein by reference in their entireties.

This invention relates to an actuator for a downhole tool, and in particular to an actuator which can be cycled repeatedly, as required, to achieve a desired level of control over the downhole tool, and which permits the application of relatively large actuation loads.

One technique in common use in controlling the operation of a downhole tool makes use of an activating ball which is dropped from the surface within the drill string. The movement of the ball is temporarily arrested when it reaches the actuator by engagement of the ball with part of the actuator. In some types of actuator, the ball may temporarily close or restrict fluid flow along a passage, diverting the fluid flow to a location in which it can be used to achieve a desired effect. Alternatively, the ball may cooperate with a seating in such a manner that the pressure upstream of the ball and seating rises, physically displacing the seating and, for example, a sleeve upon which the seating is formed to achieve the desired effect. After the desired effect has been achieved, the ball may pass through the seating allowing the normal fluid flow to be restored.

U.S. Pat. No. 7,661,478 describes a ball drop circulation valve in which a collet is provided to serve as a seat with which a dropped ball can engage, allowing a pressure differential to be generated across the ball. This pressure differential results in a force being experienced driving the collet, and a sleeve connected to the collet, to a position in which the sleeve no longer covers an opening or port provided in a housing. Once in this position, the seat defined by the collet is located in a part of the housing of relatively large internal diameter, allowing the collet to expand and so allowing the ball to pass from the collet. Once the ball has passed from the collet, it will be appreciated that fluid is able to flow through the valve in the normal manner. The arrangement described in U.S. Pat. No. 7,661,478 is not intended to be repeatedly cycled. It includes two separate collets moved, in use, by respective dropped balls. Dropping of a first ball and engagement of that ball with one of the collets drives a first valve member to open the port. Subsequent dropping of a second ball and engagement of that ball with the other of the collets drives a second valve member to close the port. Once the port has been closed, re-opening of the port is not permitted. Thus, after opening and subsequent closing of the port, further cycling of the actuator is not undertaken.

In U.S. Pat. No. 7,661,478, along with other known arrangements such as that described in U.S. Pat. No. 7,581,596, movement only occurs once the pressure differential across the ball applies a large enough force to result in permanent shearing of a shear pin used to hold the collet or other component against movement.

Where the application in which the actuator is used requires repeated operation, these actuators are unsuitable for use.

WO2011/094274 describes an arrangement in which a ball dropping onto a seating acts as a piston, moving a support until it reaches a release position. It is thought that if high pressure fluids were applied to such an arrangement, the load applied by the ball to the seating would urge the seating to expand, resulting in the application of a braking load which could prevent or impair the reliable, efficient operation thereof.

Other, similar, dropped ball operated valves or devices are described in, for example, U.S. Pat. No. 6,155,350 and US2011/0284233.

U.S. Pat. No. 4,051,899 describes a dropped ball operated valve which can be reset, repeatedly, by the use of a special resetting tool, and in which the dropped ball is retrieved. The requirement to use a special tool to reset the valve, and retrieval of the dropped ball, make this type of device inconvenient to use, and unsuitable for use in applications in which regular, repeated actuation is required.

US2007/0089912 describes an under reamer in which axial movement of a control member is used to drive a reamer blade for inward or outward movement. Another under reamer device is described in GB2446294. Other tools including similar functionality are described in, for example, WO2008/070052, US2008/105465 and US2008/070038.

Generally, the control arrangement used in controlling the operation of an under reamer, for example that described in US2007/0089912, must be capable of repeatedly actuating the device to expand and retract the reamer blade when required. As mentioned hereinbefore, the typical dropped ball actuators are either unable to be operated in this manner or are inconvenient to use in this manner. There is a need, therefore, to provide a dropped ball actuator which is capable of being reset for repeated actuation and which is suitable for use in such applications. Furthermore, it is desirable for the actuator to be able to apply or transmit relatively large magnitude loads.

An object of the invention, therefore, is to provide an actuator suitable for use in such applications and which permits repeated actuation or cycling in a convenient manner.

According to the present invention there is provided a resettable downhole tool actuator comprising a housing, a support located within the housing and being axially movable relative thereto, the support carrying or defining a piston, a collet carried by the support and defining a seating with which a ball is engageable such that, in use, when the ball engages the seating, fluid flow through an axially extending passage provided in the support is restricted, increasing the fluid pressure to which the piston is exposed thereby applying an increased load to the support urging the support for movement relative to the housing, wherein the housing includes an increased diameter region arranged such that, when the seating is aligned with the increased diameter portion, outward deflection of the collet permits the ball to pass through the seating and through the axially extending passage.

In such an arrangement, when the actuator is to be operated, a ball is dropped so as to be received on the seating, restricting fluid flow through the axially extending passage and so generating a pressure differential across the piston sufficient to drive the collet and support for movement within the housing. When the collet reaches the position in which the seating is aligned with the increased diameter region, passage of the ball through the seating and passage allows the pressure differential to be reduced. The collet and support can then be returned to their original positions, or at least to a position in which the collet is upstream of the increased diameter region, resetting the actuator in readiness to be actuated by the dropping of another ball.

Preferably the piston is located downstream of the collet. Consequently, the load urging the support for movement does not need to be transmitted through the collet fingers, reducing the risk of damage thereto and increasing the magnitude of the load which can be applied by the actuator.

A spring biasing means may be provided to return the collet and support to, or towards, their original positions. Alternatively, an external mechanism, for example forming part of the device controlled using the actuator, or an appropriate pressure differential may be applied across the piston by external means to drive the piston and the support, and hence the collet, to, or towards, the original position.

It will be appreciated that by providing such a resettable actuator, repeated actuation can be achieved which, depending upon the application in which the actuator is to be used, may be beneficial.

The seating is conveniently defined by inwardly extending fingers of the collet. The support conveniently extends to a position adjacent the fingers defining the seating, providing support for the fingers and so reducing the risk of damage thereto as a result of the compressive loadings experienced thereby, in use. A spring may be provided to urge parts of the fingers against an end of the support.

Figure 2:
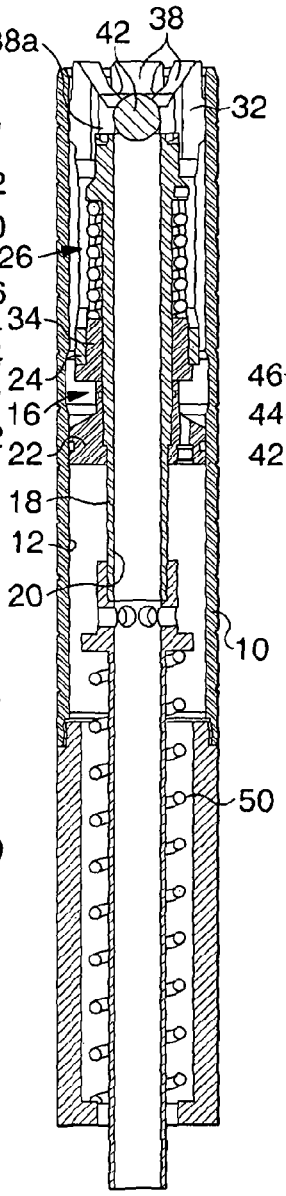
Figure 3:
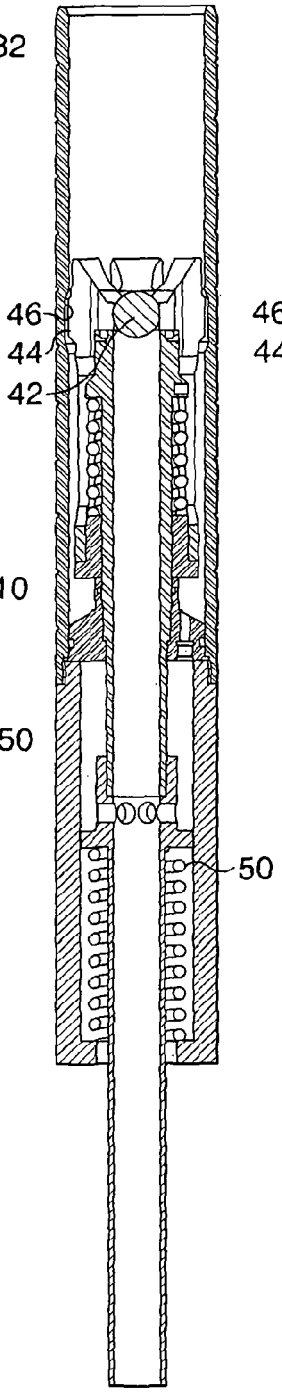
Figure 4:
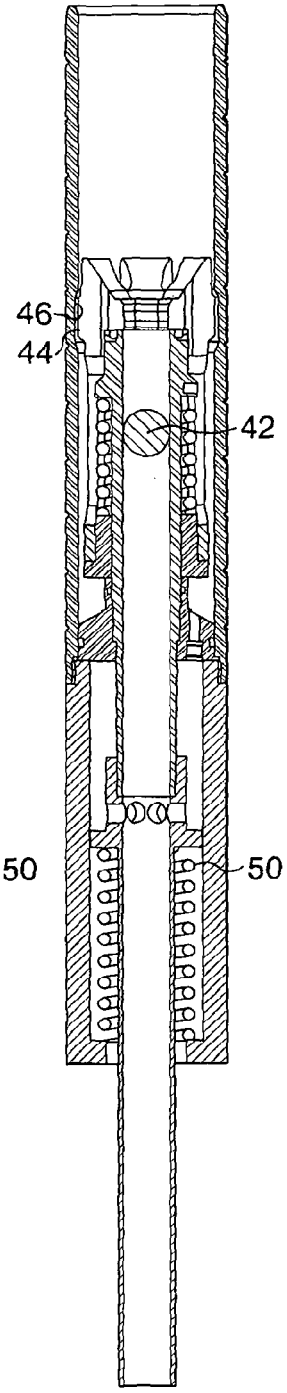
Figure 5:
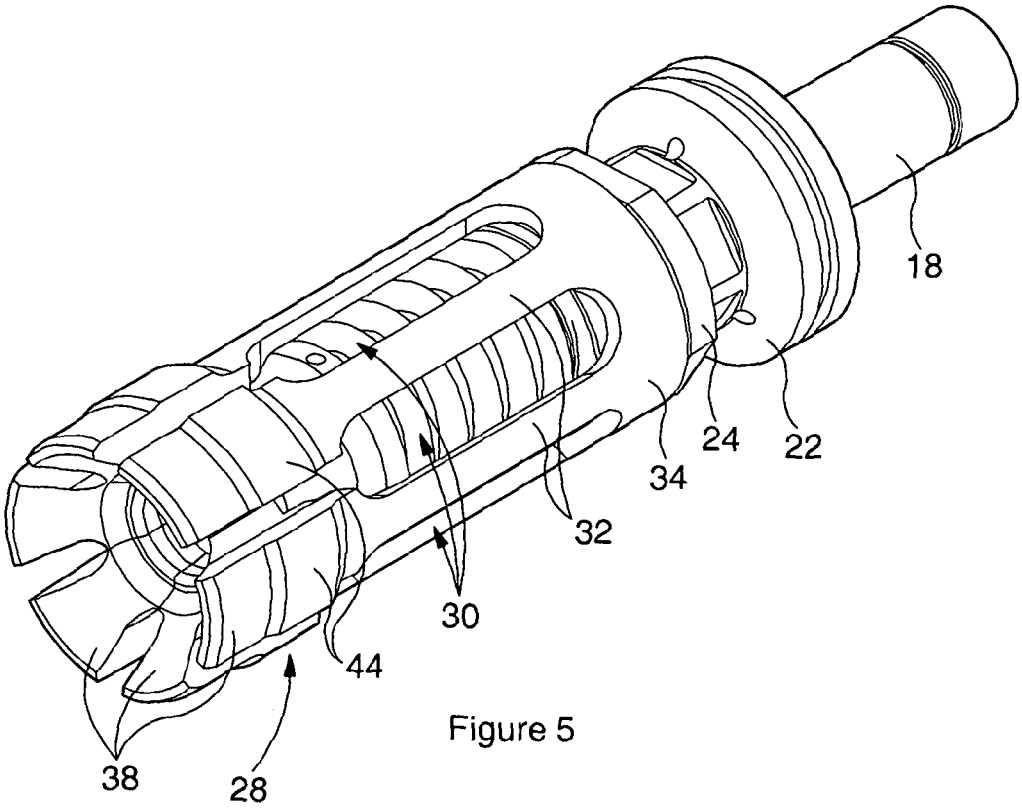

The invention will further be described, by way of example, with reference to the accompanying drawings, in which:

FIG. 1 is a sectional view illustrating a downhole tool actuator in accordance with an embodiment of the invention;

FIGS. 2, 3, and 4 are views similar to FIG. 1 and illustrating the operation of the actuator; and FIG. 5 is a perspective view showing part of the actuator of FIG. 1.

Referring firstly to FIGS. 1 and 5, a resettable downhole tool actuator is illustrated which comprises a tubular housing 10 arranged, in use, to have fluid supplied thereto, the fluid flowing through the bore 12 of the housing and exiting from a lower end 14 thereof. Whilst the description herein includes references to above, below, etc, it will be appreciated that these terms are used for convenience and that, in use, the downhole tool actuator may be orientated differently to that described.

Within the housing 10 is located a support 16 in the form of a tube. The support 16 is of multi-part form and includes a central shaft 18 provided with an elongate, axially extending passage 20 of generally uniform diameter, and a piston 22 mounted upon the outer periphery of the shaft 18, part way along the length thereof, the piston 22 forming a substantially fluid tight seal with the inner wall of the housing 10. As illustrated, the exterior of the shaft 18 is conveniently of stepped form, the piston 22 cooperating with one or more of the steps to prevent axial movement thereof along the length of the shaft 18.

A collar 24 is fitted around a central part of the shaft 18, the collar 24 carrying a collet 26 which extends from the collar 24 to an upstream end of the shaft 18. The collet 26 takes the form of a hollow cylindrical body 28 which is machined, for example by electric spark erosion, to form a series of slots 30 therein, resulting in the formation of a series of axially extending arms 32 which are integrally formed with an annular part 34, the annular part 34 being carried by the collar 24. The slots 30 are of relatively large dimensions, thereby defining a relatively large flow path (best seen in FIG. 5) between an upstream end of the collet 26 and a chamber 36 radially outward of the collet 26 and adjacent an upstream end surface of the piston 22.

It will be appreciated that the piston 22 is downstream of the collet 26, and hence that loads applied to the shaft 18 via the piston 22 are independent of, and do not need to be transmitted through or borne by, the collet 26.

The upstream end of each arm 32 includes an inwardly extending finger 38, the inner ends of the fingers 38 together defining a seating 40 with which a ball 42 can cooperate, in use, to operate the actuator. In the position shown in FIG. 1, the diameter of the seating 40 is slightly less than the diameter of the ball 42. The ball 42 and passage 20 are of dimensions such that the ball 42 is able to pass through the passage 20 but with only a small clearance.

Each arm 32 includes an outwardly projecting part 44 which, as shown in FIG. 1, bears against the inner surface of the housing 10. The cooperation between the parts 44 and the housing 10 prevents significant outward movement of the arms 32 and fingers 38, and so prevents enlargement of the diameter of the seating 40. Part way along the length of the housing 10 is formed a recess 46 which, when the parts 44 of the arms 32 are aligned therewith, allows outward movement of the arms 32 and fingers 38, enlarging the diameter of the seating 40 to a degree sufficient to allow the passage of the ball 42 therethrough. The arms 32 are resilient, being biased towards their inner positions.

Each finger 38 is shaped such that a part 38*a* thereof rests against the upstream end of the shaft 18 so that axial loads experienced by the fingers 38 are transmitted to the shaft 18. A spring 52 is in engagement with the collar 24, applying a load thereto urging the collet 26 towards a position in which the fingers 38 abut the end of the shaft 18. Consequently, regardless as to the position occupied by the actuator, engagement of a ball 42 in the seating 40 will substantially seal the passage 20, the fingers 38 already being in engagement with and substantially sealing with, the end of the shaft 18.

In use, prior to actuation, the actuator normally occupies the position shown in FIG. 1. Fluid is able to flow through the housing 10 primarily by passing through the passage 20 formed in the shaft 18. As a consequence, no significant pressure differential is experienced across the piston 22. The piston 22, shaft 18 and collet 26 thus remain in the position shown.

When it is desired to actuate a device such as an under reamer, for example of the general type described in US2007/0089912, controlled by the actuator, a ball 42 is dropped from the surface through the associated tubing string. When the ball 42 reaches the actuator it will come to rest in the seating 40. As mentioned hereinbefore, the diameter of the seating 40 is such that the ball 42 is unable to pass through the seating 40. The fingers 38 are shaped in such a manner as to direct the ball 42 into the seating 40. Furthermore, when the ball 42 is dropped into the tubing string, fluid will typically be being pumped along or through the tubing string, assisting in carrying the ball 42 to the actuator, and the flow of fluid will carry the ball 42 onto the seating 40.

As the seating diameter is smaller than that of the ball 42, movement of the ball 42 will be arrested. The operation of the pump may mean that the ball is travelling at a significant speed prior to the movement being arrested, and the cooperation of the parts 44 of the arms 32 with the wall of the housing 10 serves to resist significant axial movement of the collet 26 at that time. It will be appreciated that the engagement of the ball 42 with the seating 40 will apply a force to the fingers 38 urging them outward, compressing the parts 44 against the wall of the housing 10, and so increasing the braking effect resisting significant axial movement of the collet 26 arising from the inertia of the ball 42.

Once the ball 42 is in engagement with the seating 40, as shown in FIG. 2, the flow of fluid along the passage 20 is significantly restricted, and the continued supply of fluid to the tubing string will result in the generation of a significant pressure differential across the piston 22. This pressure differential rises to a point at which it is sufficient to drive the piston 22, and consequently the shaft 18 and collet 26 axially within the housing 10, against any resistance to movement within the actuator and arising from the operation of devices operated by the actuator. The axial movement may bring the lower end of the shaft 18 into engagement with a part of the tool to be actuated, driving it for movement. By way of example, the actuator may be used to drive an under reamer between its operating conditions.

It will be appreciated that the load applied to the shaft 18 urging it for movement is applied primarily via the piston 22. Compression of the arms 32 is limited by virtue of the engagement of the fingers 38 with the end of the shaft 18. Furthermore, as the piston 22 is located downstream of the collet 26, the applied load does not need to be transmitted through the collet 26. The risk of damage to the arms 32 is thus minimised and the fluid pressure to which the actuator can be exposed without sustaining damage, and hence the magnitude of the actuating load that can be applied by the use of the actuator, are increased.

The movement of the piston 22 will eventually result in the collet 26 reaching the position shown in FIG. 3 in which the parts 44 of the arms 32 are aligned with the recess 46. Once this position is reached, it will be appreciated that outward movement of the fingers 38 is no longer prevented, and the continued application of fluid pressure on the ball 42 urges the ball 42 further into the seating 40, pushing the fingers 38 outwards, this movement being accompanied by corresponding outward deflection of the arms 32. The movement of the fingers 38 expands the diameter of the seating 40 to a point large enough to allow the ball 42 to pass completely through the seating 40, entering and passing through the passage 20 as shown in FIG. 4 and ultimately exiting the actuator.

Once the ball 42 has passed through the seating 40, the resilience of the arms 32 returns the seating 40 to its original size. The actuator can then be returned to the position shown in FIG. 1, or at least to an intermediate position in which the seating 40 is upstream of the recess 46, for example under the action of a biasing spring 50, by the application of an appropriate pressure thereto, or by other mechanical means (not shown). Once returned to the position shown in FIG. 1, or at least towards that position, it will be appreciated that the actuator is reset, ready for re-activation in the same manner by the dropping of another ball. The actuator may be cycled through this actuation procedure repeatedly, as desired.

As described hereinbefore, the fingers 38 rest upon the end of the shaft 18. Consequently, the transmission of axially directed compressive loads through the arms 32 of the collet is very much reduced, such loads being transmitted directly through the fingers 38 to the shaft 18, and the majority of the applied load being transmitted directly from the piston 22 to the shaft 18 in any event. Where the actuator is used in controlling the operation of a multi-cycle under reamer, the force required to operate the under reamer may be of the order of 50000 lbs, and so the ability to transmit loadings of this order directly to the shaft 18 rather than having to design the arms 32 and unsupported parts of the fingers 38 in such a manner as to be able to withstand such loadings is very advantageous. The risk of damage to the collet 26 is thus reduced. Furthermore, the dimensions of the arms 32 can be reduced, resulting in release of the ball 42 once the actuator reaches the position shown in FIG. 3 being achieved reliably. The provision of the large slots 30 is further advantageous in that it reduces the pressure imbalance between the radially inner surfaces of the arms and the radially outer surfaces thereof, again assisting in ensuring reliable release of the ball 42 when the position shown in FIG. 3 is attained by reducing the magnitude of the radially directed load required to achieve deflection of the arms 32 and release of the ball 42.

Whilst one embodiment of the invention is described herein, it will be appreciated that a wide range of modifications and alterations may be made thereto without departing from the scope of the invention as defined by the appended claims. Furthermore, whilst reference is made herein to the use of the actuator in controlling the operation of an under reamer, it will be appreciated that it may also be used in other application, for example in controlling the operation of a multi-cycle circulation sub or another downhole device.

The invention claimed is:

1. A resettable downhole tool actuator comprising a housing, a support located within the housing and being axially movable relative thereto, the support carrying or defining a piston, a collet carried by the support, the collet comprising a series of arms that lie alongside the support and a series of inwardly extending fingers carried by the arms and which together define a seating with which a ball is engageable such that, in use, when the ball engages the seating, fluid flow through an axially extending passage provided in the support is reduced, increasing the fluid pressure to which the piston is exposed thereby applying an increased load to the support urging the support for movement relative to the housing, wherein the housing includes an increased diameter region arranged such that, when the seating is aligned with the increased diameter portion, outward deflection of the collet permits the ball to pass through the seating and through the axially extending passage, the support extending to a position adjacent the fingers, a part of each finger resting against an upstream end of the support so that axial loads experienced by the fingers are transmitted to the support.

2. An actuator according to claim 1, wherein the piston is located downstream of the collet.

3. An actuator according to claim 2, wherein the collet defines a plurality of slots forming flow passages whereby, in use, fluid is applied to the piston.

4. An actuator according to claim 1, further comprising a spring biasing the collet towards an axial position in which the inwardly extending fingers bear against an end of the support.

5. An actuator according to claim 1, wherein the arms comprise deflectable arms, and wherein each arm includes a projecting part on its outer face.

6. An actuator according to claim 5, wherein large slots are formed between the deflectable arms.

7. An actuator according to claim 1, and further comprising a spring to return the support toward its original position.

8. An under reamer arrangement comprising an under reamer, and an actuator according to claim 1 and operable to control operation of the under reamer.

9. An under reamer arrangement as claimed in claim 8, wherein the under reamer is operable to apply a force to the support to return the support to its original position.

* * * * *